United States Patent [19]

Lewis, Jr.

[11] 4,206,918

[45] * Jun. 10, 1980

[54] LACROSSE STICK WITH KNURLED METALLIC HANDLE

[75] Inventor: Fielding H. Lewis, Jr., Towson, Md.

[73] Assignee: Wm. T. Burnett & Co., Inc., Baltimore, Md.

[ * ] Notice: The portion of the term of this patent subsequent to Jul. 26, 1994, has been disclaimed.

[21] Appl. No.: 867,837

[22] Filed: Jan. 9, 1978

[51] Int. Cl.[2] ..... A63B 59/02

[52] U.S. Cl. ..... 273/326

[58] Field of Search ..... 273/67 R, 68, 72 A, 273/73 H, 80 R, 80 B, 96 D

[56] References Cited

U.S. PATENT DOCUMENTS

| | | | |
|---|---|---|---|
| 1,540,559 | 6/1925 | Murphy | 273/80 B |
| 1,573,707 | 2/1926 | Hoerle | 273/80 B |
| 1,787,415 | 12/1930 | Washington | 273/80 B |
| 1,980,655 | 11/1934 | Balistreri | 273/81 R X |
| 2,318,682 | 5/1943 | Fawick | 273/81 R |
| 2,472,930 | 6/1949 | Wilkes | 273/80 B |
| 2,508,519 | 5/1950 | Jay | 273/96 D |
| 3,106,398 | 10/1963 | Gowdey | 273/84 R |
| 3,473,806 | 10/1969 | Patterson | 273/96 D |
| 3,507,495 | 4/1970 | Tucker | 273/96 D |
| 3,530,048 | 9/1970 | Darrow | 273/80 R |
| 3,685,135 | 8/1972 | Letters | 273/80 B |
| 3,702,702 | 11/1972 | Hoult | 273/96 D |
| 3,854,316 | 12/1974 | Wilson | 273/72 A X |
| 4,037,841 | 7/1977 | Lewis | 273/96 D |

FOREIGN PATENT DOCUMENTS

| | | | |
|---|---|---|---|
| 447371 | 3/1948 | Canada | 273/81 R |
| 518699 | 3/1940 | United Kingdom | 273/80 B |

OTHER PUBLICATIONS

Chemical Engineers' Handbook; 1941; p. 2138.

*Primary Examiner*—Richard J. Apley
*Attorney, Agent, or Firm*—A. W. Breiner

[57] ABSTRACT

A lacrosse stick having a tubular metallic handle with knurling at the surface of the handle to provide improvement in grip and handling characteristics under all weather conditions. The metallic handle is preferably of aluminum alloy and elliptical in cross section, with the major axis of the elliptical shape being normal to the general plane of the lacrosse stick head. Dimensions and physical properties of the handle material are interrelated to provide desired balance of the lacrosse stick from the standpoint of handling by players, durability, freedom from failure by fracturing, and standardization in production.

6 Claims, 5 Drawing Figures

LACROSSE STICK WITH KNURLED METALLIC HANDLE

This invention relates to lacrosse sticks, and especially to a lacrosse stick including a knurled metallic handle which has physical properties and is formed to provide advantages as to grip, strength, safety, weight distribution, and comfortable feel in the hands of a player.

BACKGROUND OF THE INVENTION

In the early prior art, lacrosse stick handles were customarily made of wood, usually hickory, shaped by American and Canadian Indians with whom the game originated. Such handles lack uniformity as to quality, strength, weight, and feel in the hands of a player. Additionally, wooden handles were susceptible to failure by fracturing, leaving jagged ends with a resultant extreme danger of severe injury to players in a game so roughly played.

U.S. Pat. No. 3,702,702 to Hoult dated Nov. 14, 1972 proposes the use of a lacrosse stick handle comprising a composite of an outer plastic tube (illustrated as non-metallic) of octagonal cross section and an inner core of wood or aluminum. Moreover, many attempts were made to provide handles of metallic construction. However, all attempts were unsuccessful due to inadequate strength or in that they were too heavy, and/or they did not have the desired player feel until the introduction of the tubular metallic handle as described in U.S. Pat. No. 4,037,841 issued July 26, 1977. Although the handle described in U.S. Pat. No. 4,037,841 is highly desirable and is widely accepted by players, the handle at times, while better than wooden or plastic sticks, under certain playing conditions, including wet and freezing weather, lacked complete control.

OBJECTS OF THE INVENTION

An object of the present invention is to provide a lacrosse stick having a tubular metallic handle overcoming disadvantages of prior art handles, especially with respect to standardization, desirable weight distribution with the stick head, strength and avoidance of fracturing, and having improved grip under virtually all conditions.

Another object of the invention is to provide a metallic stick which has improved handling characteristics under all weather conditions.

Other objects of the invention will become apparent from the following description and drawings.

GENERAL DESCRIPTION OF INVENTION

The objects of the present invention are accomplished by providing a tubular metallic handle which is of circular cross section, or is generally of circular cross section, and preferably elliptical in shape as defined in the before-mentioned U.S. Pat. No. 4,037,841, with the additional feature that the handle contains knurling over a substantial portion of the area which is gripped by the player. The knurling not only provides improved grip, but also provides improved handling characteristics under all weather conditions which is an important feature of a lacrosse stick. Thus, the handle has the requisite player feel which, although an intangible characteristic, is of real and critical importance in the fabrication and manufacture of a lacrosse stick. Moreover, the handle of the invention provides the essential balance between weight distribution, physical properties, control under all conditions, and the desired feel in the hands of a player.

Figure 1:
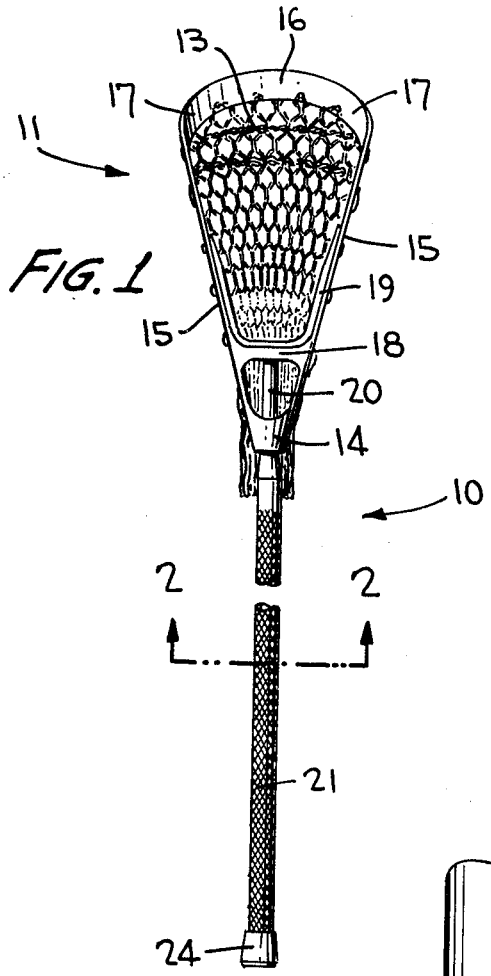
FIG. 1 is an elevational view of a lacrosse stick, the handle partly broken away, embodying the invention.

The illustrative embodiments of the invention are of a lacrosse stick generally designated 10 which includes a head generally designated 11 and a handle generally designated 12. The head is provided with webbing or netting generally indicated at 13.

The head 11 is constructed similarly to a head disclosed in the Tucker et al U.S. Pat. No. 3,507,495 of Apr. 21, 1970 and shown also in a later Tucker et al U.S. Pat. No. 3,822,062 of July 2, 1974. The head 11 is, in general, a closed frame-like construction with a generally V-shape design preferably substantially symmetrical. The lower end of the head is formed as a throat 14 from which two side walls 15, 15 are inclined and diverge upwardly and outwardly. The upper ends of the side walls 15, 15 are connected by a transverse top or end wall 16 which merges with the side walls through intervening smoothly curved portions 17, 17.

A transverse stop 18 extends between the side walls 15, 15 and cooperates with the throat 14 and adjacent portions of the side walls to facilitate the connection of the head 11 and the handle 12. Positioned inside the stop 18 is a layer 19 of relatively soft resilient material which provides for improved ball handling properties.

The Tucker et al, U.S. Pat. No. 3,882,062 more particularly discloses an arrangement which may be embodied in the webbing 13 shown in FIG. 1 by the way of example. Since details of construction of the webbing per se are not part of the present invention, reference to U.S. Pat. No. 3,822,062 is, therefore, sufficient as to disclosure of one suitable kind of webbing.

The head 11, aside from the webbing 13, is preferably formed as a unitary molding of a polymeric material characterized by toughness, high impact resistance, and limited flexibility as well as other desirable properties explained in the aforesaid U.S. Pat. No. 3,507,495. A presently preferred material is a nylon resin marketed under the duPont trademark ZTEL ST 801. This polymer has outstanding impact resistance and good moldability permitting injection molding. Unreinforced ZTEL ST 801, with a water content of 0.2 percent, at 73° F. using the ASTM test method D638 has a tensile strength of 7800 psi, a yield strength of 7800 psi, and an elongation at break of 40 percent. It has a specific gravity of 1.09 using the ASTM test method D792, and a Rockwell hardness of R112 using ASTM test method D785. Another material suitable for making head 11 is the reaction product of Adiprene L315 and 4,4'-methylene-bis-(2-chloroaniline) using the formulation and manufacturing procedure as set forth in the aforesaid U.S. Pat. No. 3,507,495, the disclosure of the '495 patent being incorporated herein by reference. The above-noted materials are examples of materials suitable for constructing the head found to cooperate admirably with the handle of the present invention.

Figure 2:
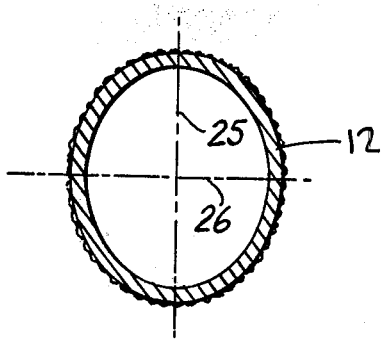
FIG. 2 is a cross section on line 2—2 of FIG. 1.

The invention, as above noted, is primarily related to the handle 12, although the correlation between the head and the handle is a further aspect of the invention. Primarily, the handle is formed of metal tubing, which, in the illustrative embodiment, is cold drawn seamless aluminum alloy tubing. As shown in FIG. 1, the handle has a relatively longitudinally short top end part 20 of circular cross section and a relatively longer part 21 which is preferably of elliptical cross section, as shown in FIGS. 1 and 2, extending throughout the major part of the handle. The head throat 14 and stop 18 have aligned openings, as apparent from FIG. 1, which receive the circular cross section end part 20 of the handle 12 for detachably connecting the handle to the head. Any suitable fastening device such as a screw, not shown, can be used for releasably securing the head to the handle.

A cap 24 of relatively soft material such as rubber or plastic is fitted over the lower end of the handle.

Figure 4:
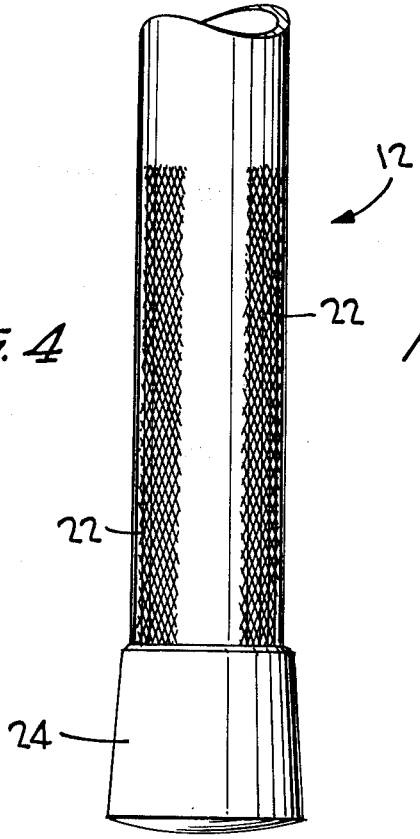
FIG. 4 is an enlarged scale perspective view of a part of a lacrosse stick handle showing one preferred knurling design.
Figure 5:
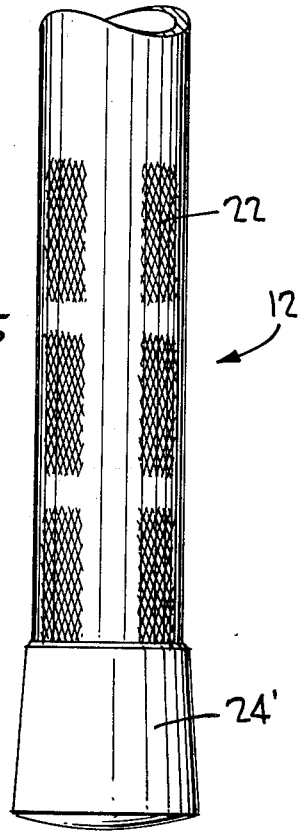
FIG. 5 is an enlarged scale perspective view of a part of a lacrosse stick handle showing another preferred knurling design.

As shown in FIG. 1, the diamond knurl 21 extends from cap 24 substantially up to the end part 20 which fits into the throat portion 14 and stop 18 of head 11. Although the handle preferably contains the knurling over substantially the entire surface of the handle, an alternative embodiment as shown in FIG. 4 has the knurling 21 in longitudinal strips 22 extending substantially the full length of handle 12, or the longitudinal strips 22 can be broken as shown in FIG. 5. The essential feature is to provide sufficient knurling to improve the grip characteristics of the metallic handle and to provide the essential player feel.

Figure 3:
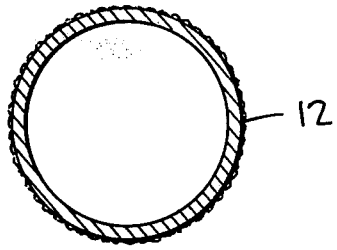
FIG. 3 is a cross section of another embodiment of the lacrosse stick handle.

As shown in FIGS. 1 and 2, the handle is preferably elliptical in cross section as fully described in my earlier U.S. Pat. No. 4,037,841. As seen in FIG. 2, the elliptical handle has a major axis 25 and a minor axis 26. However, the knurling of the present invention permits the use of a circular cross section, as shown in FIG. 3, without substantial detriment.

As further described in my earlier U.S. Pat. No. 4,037,841, the upper end part 20 of the handle is swaged to a reduced diameter to fit through the opening in throat 14 and extend into stop 18. As further described in my earlier U.S. Pat. No. 4,037,841, dimensional relationships may vary according, for example, to whether the handle is to be part of a lacrosse stick used by attack and midfield players or is to be used by defense players. Generally considered, lacrosse sticks used by defense players may suffer more frequent and sometimes more severe shocks, as by impact, than the attack and midfield sticks.

Factors of lightness, limited flexibility and strengh contribute to the suitability for use by attack and midfield players. In a preferred handle for an attack and midfield stick, using an alluminum alloy as disclosed hereinafter, a preferred wall thickness is 0.065 inch, although a wall thickness in the range 0.045 inch to 0.090 inch may be used in accordance with the invention. An important consideration, when the handle is elliptical, is the ratio of the length of the minor axis of the elliptical cross section to the length of the major axis. Balancing the considerations of comfortable feel in the hands of the player, resilience, strength and resistance to deformation, an optimum ratio of 0.88 of the length of the minor axis to the length of the major axis is preferred. This ratio is based on a minor axis length of from 0.925 inch to 0.955 inch and a major axis length of from 1.050 inch to 1.080 inch for handles incorporated in attack and midfield sticks. The ratio may, however, range from 0.80 to 0.93, although a ratio within the range 0.83 to 0.90 is preferred.

Different balancing of a lacrosse stick may be preferred by different players. However, as a general guideline, reference is made to a typical stick in which the head weighs substantially 11 ounces and the attack and midfield handle weighs approximately 0.224 pounds per lineal foot. Weights may vary, for example, as to whether a lacrosse stick is to be used by junior players or varsity or professional players. Nevertheless, the relative weights of the handle and head preferably come within reasonable ranges. For example, for a head within the range of 9 ounces to 13 ounces, the weight of the handle should preferably be within the range 0.220 to 0.285 pounds per lineal foot. The total weight of the handle may vary according to its length. For an attack or midfield stick, the handle may be furnished about 40 inches long and the players using the stick may cut it down to any length of from 26 to 40 inches to suit the player's individual feel and preference.

Since lacrosse sticks are subjected to rough contact, especially whacks or blows, physical properties of the handle material are important. Of outstanding importance is the modulus of elasticity, although ultimate strength, yield strength and elongation have to be considered. The modulus of elasticity is defined as the ratio of stress to corresponding strain throughout the range where they are proportional. In this disclosure, the modulus of elasticity is considered as an average of the modulus in compression and the modulus in tension, the compression modulus being roughly 2 percent greater than the tension modulus.

For use in a handle for an attack-midfield stick the preferred modulus of elasticity as defined above is $10.0\times10^3$, ksi being thousand pounds per square inch. While this is the preferred value, the modulus of elasticity may be within the range $10.0\times10^3$ to 10.4 ksi$\times10^3$, depending upon the stiffness desired, and even some reasonable departure from that range may be tolerated.

An aluminum alloy having such a modulus of elasticity preferably has an ultimate strength (tension) of 40 ksi, a yield strength (tension) 35 ksi and an elongation of 8 percent in 2 inches, although good results are obtainable with a range of ultimate strength (tension) 40–45 ksi, yield strength (tension) 35–40 ksi and elongation 5–12 percent in 2 inches. Some variation reasonably beyond such ranges, according to availability of alloys, may be acceptable while still obtaining advantages of the invention.

A lacrosse stick handle of an alloy having physical properties such as are set forth will not fracture when subjected to heavy load, as by impact, as would a wood or fiberglass handle. Any stress induced failure of a handle would be by way of plastic deformation, minimizing the danger of injury to a player.

Preferred aluminum alloys are those designated 6061-T6, T651 and 6063-T835 in "aluminum standards and data 1972–73" published by THE ALUMINUM ASSOCIATION, 750 THIRD AVENUE, NEW YORK, N.Y. 10017 hereinafter referred to as ASD. This publication gives physical properties on which the foregoing disclosure is based, as well as chemical analyses limit ranges of the alloys. The following is given for the 6061 group alloys:

| | |
|---|---|
| Silicon | 0.40–0.8 |
| Iron | 0.7 |

| | |
|---|---|
| Copper | 0.15–0.40 |
| Manganese | 0.15 |
| Magnesium | 0.8–1.2 |
| Chromium | 0.04–0.35 |
| Zinc | 0.25 |
| Titanium | 0.15 |
| Others, each | 0.05 |
| Others, total | 0.15 |
| Aluminum | Remainder |

The following analysis given by limits by the publication ASD for the 6063 alloys group:

| | |
|---|---|
| Silicon | 0.20–0.6 |
| Iron | 0.35 |
| Copper | 0.10 |
| Manganese | 0.10 |
| Magnesium | 0.45–0.9 |
| Chromium | 0.10 |
| Zinc | 0.10 |
| Titanium | 0.10 |
| Others, each | 0.05 |
| Others, total | 0.15 |
| Aluminum | Remainder |

Alloys referred to above are suitable for use in the handles of attack-midfield sticks. Other alloys having the required and similar physical properties may be used.

Handles for defense sticks which are of elliptical cross section and should be of material having physical properties as set forth above. As in the case of handles for attack and midfield sticks, aluminum alloys 6061-T6, T651 and 6063-T835 may be used. However, because of the rougher use to which defense sticks may be subjected, there are some differences in the dimensions of the defense stick handle as compared to those of the attack and midfield handle. Balancing such factors as lightness and strength, the optimum wall thickness of a defense stick handle is 0.065 inch, somewhat above the 0.045 inch thickness of the attack and midfield handle wall thickness. The defense handle wall thickness may vary in a range up to 0.090 inch. A defense stick handle having the optimum wall thickness 0.065 inch weighs 0.224 pounds per lineal foot. A defense stick head is only slightly heavier than an attack and midfield stick head, that is approximately 11 ounces in a typical case, but the weight of the defense stick head may range up to 13 ounces. Normally a defense stick is furnished with a handle 58 inches long, and the particular player may cut it down to suit his individual feel and preference to 44 inches long or even less.

As in the case of an attack and midfield stick handle, the defense stick handle has an elliptical cross section, the ratio of the length of the minor axis to the length of the major axis preferably being 0.88. This is based on a minor axis length of from 0.925 to 0.955 inch and a major axis length of from 1.050 inch to 1.080 inch. The ratio may range from 0.80 to 0.93, although a ratio within the range 0.83 to 0.90 is preferred.

Lacrosse sticks according to this invention have the advantage of being producible with standardization in weight distribution and physical properties and hence durability. The preferred elliptical cross section provides for comfortable grasp and feel desired by players and also distributes the material of the handle so as most efficiently to withstand stress for a given weight of handle. In case of extremely hard contact, any deformation of the handle is a plastic deformation as distinguished from breaking or fracturing to which prior art wooden and fiberglass handles are susceptible. Eliminating fracturing of handles is an important safety consideration. Furthermore, handles in accordance with the invention will not warp. The advantages set forth above by way of illustration are obtained by the balancing of weight and distribution of the material in the handle of elliptical cross section taken in connection with the physical properties of the handle material. As stated, however, the knurling feature of the present invention permits use of handles circular in cross section without substantial detriment.

The lacrosse stick illustrated and described embodies the invention in a preferred form, but the disclosure is intended to be illustrative rather than definitive.

I claim:

1. A lacrosse stick comprising a head; and a tubular metallic handle of circular or generally circular cross section in which the wall thickness of said tubular handle is within the range 0.060 to 0.090 inch, said head having a weight in the range of 9 to 13 ounces, said handle weighing in the range 0.200 to 0.285 pounds per lineal foot and having knurling substantially over the entire surface of said metallic handle.

2. A lacrosse stick comprising a head; and a tubular metallic handle of circular or generally circular cross section having knurling substantially over the entire surface of said metallic handle, said handle being elliptical in cross section, the major axis of said cross section being normal to the general plane of said head, and the ratio of the length of the minor axis to the length of the major axis of said elliptical cross section is within the range 0.8 to 0.93.

3. A lacrosse stick according to claim 2 in which the ratio of the length of said minor axis to the length of said major axis is approximately 0.88.

4. A lacrosse stick according to claim 3 in which said handle is of aluminum alloy having an average of tension and compression modulus of elasticity $10.0 \times 10^3$, ksi being thousand pounds per square inch.

5. The lacrosse stick of claim 4 wherein the said knurling is arranged in longitudinal strips.

6. The lacrosse stick of claim 5 wherein the said longitudinal strips are discontinuous.

* * * * *